United States Patent [19]

Shibano

[11] 4,448,734

[45] May 15, 1984

[54] CARBURETOR

[75] Inventor: Kenji Shibano, Musashimurayama, Japan

[73] Assignee: Fuji Jukogyo Kabushiki Kaisha, Tokyo, Japan

[21] Appl. No.: 435,789

[22] Filed: Oct. 21, 1982

[30] Foreign Application Priority Data

Oct. 31, 1981 [JP] Japan ..... 56-175255

[51] Int. Cl.[3] ..... F02M 5/08

[52] U.S. Cl. ..... 261/26; 261/72 R; 261/DIG. 74; 261/DIG. 67; 261/DIG. 81; 123/519

[58] Field of Search ..... 123/518, 519, 520; 261/72 R, DIG. 67, DIG. 74, DIG. 81, 26

[56] References Cited

U.S. PATENT DOCUMENTS

| | | | |
|---|---|---|---|
| 3,802,403 | 4/1974 | Dewick et al. | 261/DIG. 67 |
| 3,852,381 | 12/1974 | Mick | 261/DIG. 67 |
| 4,208,997 | 6/1980 | Yoshida et al. | 123/519 |
| 4,270,504 | 6/1981 | Sciotti et al. | 123/519 |
| 4,343,281 | 8/1982 | Vozumi et al. | 123/519 |

FOREIGN PATENT DOCUMENTS

| | | | |
|---|---|---|---|
| 52-17129 | 8/1977 | Japan | 261/DIG. 67 |
| 55-54656 | 4/1980 | Japan | 261/DIG. 81 |
| 55-98650 | 7/1980 | Japan | 261/DIG. 81 |
| 55-117061 | 9/1980 | Japan | 261/DIG. 81 |
| 55-117060 | 9/1980 | Japan | 261/DIG. 81 |

*Primary Examiner*—Tim R. Miles
*Attorney, Agent, or Firm*—Martin A. Farber

[57] ABSTRACT

A system for preventing percolation of fuel in a carburetor for a motor vehicle. The system is provided with air passages for communicating a float chamber of the carburetor to the air and to a canister filled with charcoal particles. Valves are provided in the passages for opening the passages, when the engine operation is stopped and the temperature of the fuel in the float chamber is high. A fan is provided for introducing the air into the float chamber and for discharging the air to the canister together with vapor of the fuel in the float chamber, thereby to promote the evaporation of the fuel to cool the fuel by the evaporative cooling.

4 Claims, 1 Drawing Figure

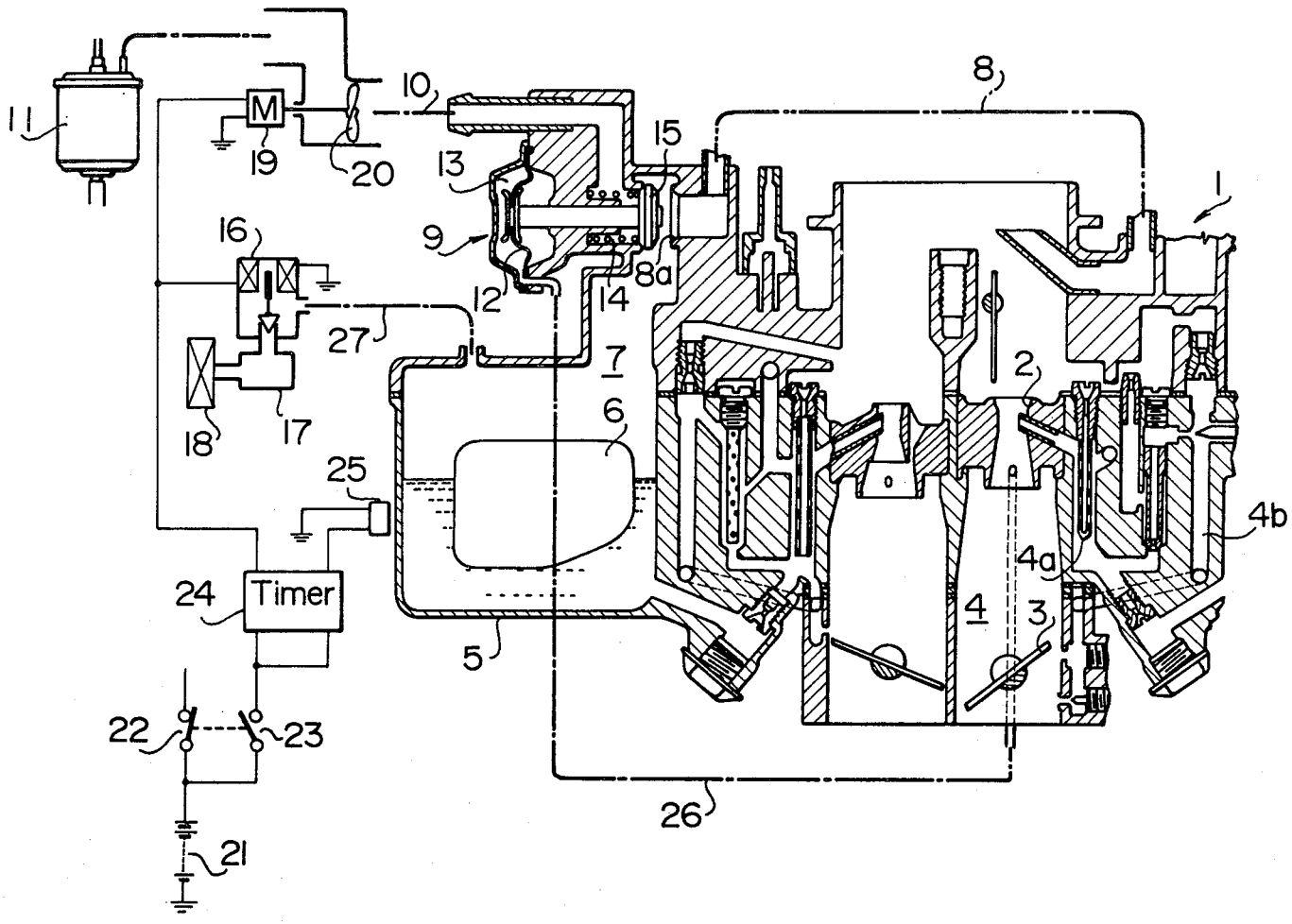
Timer

CARBURETOR

BACKGROUND OF THE INVENTION

The present invention relates to a carburetor for a motor vehicle engine and more particularly to a system for preventing the percolation of fuel to the induction passage of the carburetor.

When an engine operation is stopped after the driving of a motor vehicle at a high atmospheric temperature, the engine room reaches a high temperature which causes the elevation of temperature of fuel in the carburetor. The pressure of generated fuel vapor causes the percolation of fuel to the induction passage through air-fuel mixture passages and a float chamber vent passage. Consequently, air-fuel mixture is extremely enriched at re-starting of the engine, which deteriorates starting ability and driveability after starting.

In order to prevent the percolation of fuel, there has been proposed various measures, such as the cooling of the carburetor by a fan, insulating the carburetor by thermal insulation, and others. However, these methods are not effective on preventing of percolation, since heat capacity of the carburetor is large.

SUMMARY OF THE INVENTION

The object of the present invention is to provide a system which can effectively cool the carburetor after the stop of the engine operation for preventing the percolation.

According to an aspect of the present invention, an air introduction passage is provided for communicating a float chamber of the carburetor with the atmosphere, a solenoid valve provided in the air introduction passage for closing it. An upper portion of the float chamber is communicated with a canister through an discharge passage. A vacuum operated valve is provided in the discharge passage so as to be operated by vacuum in the induction passage of the carburetor for closing the passage and a fan is provided in the discharge passage for delivering gases to the canister. A thermo sensor is attached to the wall of the float chamber to produce a signal when the temperature of the fuel in the float chamber rises to a predetermined value. An electric control circuit is provided for opening the solenoid valve and operating the fan for a predetermined period in response to the signal of the thermo sensor, whereby the air is introduced into the float chamber and discharged to the canister together with the vapor of fuel in the float chamber of promoting the evaporation of the fuel to cool the fuel.

BRIEF DESCRIPTION OF THE DRAWING

A single FIGURE shows a sectional view of a carburetor and a system for cooling the carburetor.

DETAILED DESCRIPTION OF THE PREFERRED EMBODIMENT

Referring to the FIGURE, a carburetor 1 has an induction passage 4 provided with a venturi 2 and a throttle valve 3. A main system fuel passage **4*a* and a slow-running system fuel passage 4*b* are provided to supply air-fuel mixture from a float chamber 5 to the induction passage 4. The float chamber 5 having a float 6 is communicated with the induction passage 4 at upstream of the venturi 2 through a passage 7 formed in the carburetor body and a float chamber vent passage 8. The percolation of fuel is caused through passages 4*a* and 4*b* and further the fuel vapor is induced into the induction passage through the vent passage 8**. The present invention provides a system for preventing such an introduction of fuel into the induction passage.

To this end, a discharge passage 10 is provided to communicate with the passage 7 and a vacuum operated diaphragm valve 9 is provided at the junction of the passages 7 and 10. The valve 9 comprises a vacuum chamber 13 separated by a diaphragm 12, a valve disc 15, a spring 14 for biasing the valve disc to a seat **8*a* of the passage 8. The vacuum chamber 13 is communicated with the induction passage 4 at a venturi of the carburetor by a passage 26. The discharge passage 10 is communicated with an inside of a canister 11** which is filled with particles of charcoal for absorbing fuel vapor.

Further, the float chamber 5 is communicated with the atmosphere through a passage 27, solenoid valve 17 operated by a solenoid 16, and filter 18. On the other hand, a fan 20 driven by a motor 19 is provided in the discharge passage 10 so as to discharge fuel vapor to the canister 11. The motor 19 and solenoid 16 are electrically connected to an output of a timer 24. The timer 24 is supplied with a voltage from a battery 21 through a switch 23 and starts to operate according to a signnal fed from a thermo sensor 25. The thermo sensor 25 is attached to the wall of the float chamber 5 and adapted to generate the signal when the temperature of the wall rises to a predetermined value. The switch 23 is actuated together with an ignition switch 22 and closed when the ignition switch is opened.

In engine operating state, the pressure in the induction passage 4 becomes negative, so that the diaphragm 12 is deflected to the left by the vacuum to close the discharge passage 10 and hence the float chamber is communicated with the induction passage through the vent passage 8. Since the switch 23 is opened, the timer 24 does not operate.

When the engine operation is stopped, the pressure in the induction passage 4 rises, so that the valve disc 15 is moved to the right by the spring 14 to close the passage 8 and to open the discharge passage 10. The switch 23 is closed, applying the voltage to the timer 24. Thus, the control circuit becomes enabling state. When the temperature of the float chamber wall is low, the thermo sensor 25 does not generate a signal, the timer 24 does not act, so that the solenoid valve 17 is closed and motor 19 does not operate. If a small amount of fuel in the float chamber 5 evaporates, the generated vapor of the fuel flows to the canister 11 passing the discharge passage 10 and is absorbed in the charcoal particles in the canister 11.

When the temperature of the float chamber wall rises to a predetermined value, the thermo sensor 25 produces a signal. Thus, the timer 24 produces an output voltage for a predetermined period to operate the motor 19 and energize the solenoid valve 17 to open the valve. Accordingly, the air is introduced into the float chamber 5 passing through the filter 18 and passage 27 and further delivered into the canister together with the fuel vapor through the passages 7 and 10 by the fan 20. By current of the air through the float chamber, vapor pressure in the chamber is decreased and kept below the saturated vapor pressure. Thus, the evaporation of the fuel is promoted, so that the temperature of the surface of the fuel in the float chamber is decreased by the evaporative cooling. There occurs convection of heat in the fuel in the float chamber caused by temperature difference of the fuel. Thus, the temperature of the fuel decreases wholly to prevent the evaporation and hence percolation of the fuel.

When the predetermined time set in the timer 24 lapses, evaporation of the fuel almost terminates and the motor 19 stops and solenoid valve 17 is closed.

It will be understood that the valve 9 may be constructed by an electromagnetic valve and the solenoid valve 17 may be a vacuum operated valve.

In accordance with the present invention, since fuel is cooled by the evaporation cooling effect and generated vapor is absorbed in the canister, the percolation of the fuel can be effectively prevented.

While the presently preferred embodiment of the present invention has been shown and described, it is to be understood that this disclosure is for the purpose of illustration and that various changes and modifications may be made without departing from the spirit and scope of the invention as set forth in the appended claim.

What is claimed is:

1. A system for preventing percolation of fuel in a carburetor having a float chamber communicated with an induction passage of the carburetor through a vent passage, comprising:

a passage for communicating said float chamber with the atmosphere;

a first valve provided in said passage for closing it;

a discharge passage connected with said float chamber at an upper portion thereof;

a canister connected with a discharge end of said discharge passage, said canister being filled with fuel vapor absorbing material;

a second valve provided in said discharge passage for closing the passage and opening the vent passage;

a fan provided in said discharge passage for delivering gases to said canister;

a motor for driving said fan;

actuating means for actuating said first and second valves;

a thermo sensor operative to produce a signal when the temperature of the fuel in the float chamber rises to a predetermined value; and means for opening said first and second valves and operating said motor for a predetermined period in response to the stop of the engine operation and to said signal of said thermo sensor, whereby the air is introduced into said float chamber and discharged to said canister.

2. The system according to claim 1 further comprising a filter provided for filtering the introducing air.

3. The system according to claim 1, wherein said first valve is a solenoid valve and said second valve is a valve connected to a diaphragm in a vacuum chamber which is communicated with an induction passage of said carburetor.

4. The system according to claim 3, wherein said means includes a timer operated by said signal of thermo sensor for operating said motor and solenoid valve.

* * * * *